US006421512B2

(12) United States Patent
Watanabe et al.

(10) Patent No.: US 6,421,512 B2
(45) Date of Patent: Jul. 16, 2002

(54) IMAGE FORMING APPARATUS WITH IMAGE BEARING MEMBER CHARGER THAT REDUCES THE AMOUNT OF TONER ELECTRIC CHARGE

(75) Inventors: Yasunari Watanabe, Shizuoka-ken; Motoki Adachi, Numazu; Masao Uyama, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/749,540

(22) Filed: Dec. 28, 2000

(30) Foreign Application Priority Data

Dec. 28, 1999 (JP) ..... 11-372463
Jan. 31, 2000 (JP) ..... 2000-022017

(51) Int. Cl.[7] ..... G03G 15/30; G03G 15/02
(52) U.S. Cl. ..... 399/149; 399/50; 399/176
(58) Field of Search ..... 399/50, 71, 174, 399/149, 176, 353, 354, 357

(56) References Cited

U.S. PATENT DOCUMENTS 5,832,336 A * 11/1998 Kawasaki et al. ..... 399/71

* cited by examiner

*Primary Examiner*—Sophia S. Chen
*Assistant Examiner*—Hoang Ngo
(74) *Attorney, Agent, or Firm*—Fitzpatrick, Cella, Harper & Scinto

(57) ABSTRACT

An image forming apparatus includes an image bearing member for bearing an electrostatic image; a developing unit for developing the electrostatic image on the image bearing member with toner electrically charged to a predetermined polarity; a transfer unit for transferring the toner image from the image bearing member to a transfer material; a toner charging unit for electrically charging residual toner remaining on the image bearing member to the same polarity as the predetermined polarity; and an image bearing member charging unit for contacting to the image bearing member carrying the toner charged by the toner charging unit to electrically charge the image bearing member to the same polarity as the predetermined polarity, the image bearing member charging unit being effective to reduce a charge amount of the toner.

18 Claims, 4 Drawing Sheets

IMAGE FORMING APPARATUS WITH IMAGE BEARING MEMBER CHARGER THAT REDUCES THE AMOUNT OF TONER ELECTRIC CHARGE

FIELD OF THE INVENTION AND RELATED ART

The present invention relates to an image forming apparatus, such as a copying machine and a printer, which employs an electrophotographic, electrostatic, or the like recording system.

Conventionally, an image forming apparatus of a transfer type, such as a copying machine, a printer, a facsimile, or the like, which employs a transfer type electrophotographic recording system comprises: a photosensitive member as an image bearing member, which is generally in the form of a rotatable drum; a charging apparatus (charging process) for uniformly charging the photosensitive member to a predetermined polarity and a potential level; an exposing apparatus (exposing process), as an information writing means, for forming an electrostatic latent image on the uniformly charged photosensitive member; a developing apparatus (developing process) for developing the electrostatic latent image formed on the photosensitive member, into a toner image, or a visual image, with the use of toner, that is, developer; a transferring apparatus (transferring process) for transferring the toner image from the surface of the photosensitive drum onto transfer medium such as paper; a cleaning apparatus (cleaning process) for cleaning the surface of the photosensitive member by removing the toner remaining, although only in a small amount, on the photosensitive drum after the transfer process; a fixing apparatus (fixing process) for fixing the toner image on the transfer medium; and the like. The photosensitive member is repeatedly subjected to electrophotographic processes (charging, exposing, developing, transferring, and cleaning processes) to form an image.

The toner which remains on the photosensitive member after the transfer process is removed from the surface of the photosensitive member by the cleaning apparatus. The removed toner is collected by the cleaning apparatus, and remains as waste toner within the cleaning apparatus. From the standpoint of environmental protection, efficient usage of natural resources, and the like, it is desirable that such waste toner is not generated.

Thus, an image forming apparatus has been invented in which the so-called waste toner, that is, the toner which is recovered into the cleaning apparatus after the transfer process, is returned to the developing apparatus to be used again.

There has also been invented a cleaner-less type image forming apparatus, in other words, an image forming apparatus which lacks the cleaning apparatus, and in which the toner remaining on the photosensitive member after the transfer process is removed into the developing apparatus during the developing process, to be used again.

More specifically, the toner remaining on the photosensitive member after the transfer process, or transfer residual toner, is left untouched on the photosensitive member, and subjected to the following image forming processes. Thus, the photosensitive member with the transfer residual toner is charged, and exposed, to form an electrostatic latent image. Then, the transfer residual toner, that is, the toner which is present on the photosensitive member across the areas (non-image portions) which are not to be developed with toner, is recovered into the developing apparatus by a fog removal bias (difference Vback in potential level between the DC voltage applied to the developing apparatus and the surface voltage on the surface of the photosensitive member) in the process in which the electrostatic latent image is developed. According to this method, the transfer residual toner is recovered into the developing apparatus and used to develop the electrostatic latent image during the following rotation of the image bearing member. Therefore, no toner will be wasted, reducing the amount of the bothersome work of maintenance. In addition, being cleaner-less is advantageous in reducing image formation size.

a) A cleaner-less image forming apparatus such as the one described above, that is, an image forming apparatus in which the toner particles remaining on the photosensitive member after the transfer process are removed and recovered into the developing apparatus by the fog removal bias as the latent image on the photosensitive member is developed by the developing apparatus, has its own problem. That is, if a contact type charging apparatus which charges the surface of the photosensitive member, by coming in contact with the surface of the photosensitive member, is employed as the charging apparatus for such a cleaner-less image forming apparatus, some of the transfer residual toner particles, in particular, those the polarity of which has reversed from their normal polarity, adhere to the contact type charging apparatus, contaminating it to an intolerable level, as the transfer residual toner particles pass through the charging station, that is, the contact nip between the photosensitive member and contact type charging apparatus. This results in unsatisfactory charging of the photosensitive member.

More specifically, toner as developer mixedly contains toner particles the polarity of which has reversed from their normal polarity, although only by a small amount. Further, some of the toner particles with the normal polarity are reversed in polarity, or reduced in potential level, by transfer bias, separation discharge, and the like.

In other words, the transfer residual toner is a mixture of toner particles with the normal polarity, toner particles with the reverse polarity, and toner particles low in potential level. Thus, the toner particles with the reverse polarity, and the toner particles low in potential level, are liable to adhere to the contact type charging apparatus as they pass through the charging station, that is, the contact nip between the photosensitive member and contact type charging apparatus.

b) In order to remove and recover the transfer residual toner particles on the photosensitive member by the developing apparatus as the latent image is developed by the developing apparatus, it is necessary that the polarity of the transfer residual toner particles on the photosensitive member, which will be carried to the development station through the charging station, is normal, and also that their potential is at a level not impedimental to the development of the electrostatic latent image on the photosensitive member. The transfer residual toner particles with the reverse polarity, and the toner particles with an improper potential level, fail to be removed from the photosensitive member, and also fail to be recovered, by the developing apparatus, effecting an unsatisfactory image.

c) The adhesion of the transfer residual toner particles to the contact type charging apparatus, which was described in paragraph a), can be prevented by charging to a high potential level of the normal polarity, the transfer residual toner which is the mixture of the toner particles with the normal polarity, toner particles with the reverse polarity, and the toner particles with an insufficient potential level, so that the polarities of the transfer residual toner particles become uniformly normal.

However, after being charged by a means for controlling the potential level of the transfer residual toner particles to prevent their adhesion to the contact type charging apparatus, the potential level of the transfer residual toner particles is higher than a potential level not impedimental to the development of the electrostatic latent image on the photosensitive drum, making it difficult for them to be removed and recovered by the developing apparatus in the process in which the electrostatic latent image is developed by the developing apparatus. In this situation, the toner particles remaining on the photosensitive member overlap with the image portion formed during the following image forming rotation of the photosensitive drum, and as a result, an unsatisfactory image is produced.

With the diversification of user needs occurring in recent years, it has become necessary to continuously print images with a high printing ratio, for example, photographic images, as well as to produce color images which require multiple images to be developed in layers on the photosensitive member. Since the amount of transfer residual toner which these processes generate per rotation of the photosensitive member is much greater than that generated prior to the aforementioned diversification, the above described problem is exacerbated.

SUMMARY OF THE INVENTION

The primary object of the present invention is to provide an image forming apparatus in which the transfer residual toner particles do not adhere to the charging member.

Another object of the present invention is to provide an image forming apparatus in which the transfer residual toner particles can be recovered by the developing means.

According to an aspect of the present invention, there is provided an image forming apparatus that includes an image bearing member for bearing an electrostatic image; developing means for developing the electrostatic image on the image bearing member with toner electrically charged to a predetermined polarity; transfer means for transferring the toner image from the image bearing member to a transfer material; toner charging means for electrically charging residual toner remaining on the image bearing member to the same polarity as the predetermined polarity; and an image bearing member charging means for contacting to the image bearing member carrying the toner charged by the toner charging means to electrically charge the image bearing member to the same polarity as the predetermined polarity, the image bearing member charging means being effective to reduce a charge amount of the toner.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described.

Embodiment 1

First, the image forming apparatus (image recording apparatus) in this embodiment will be described.

Figure 1:
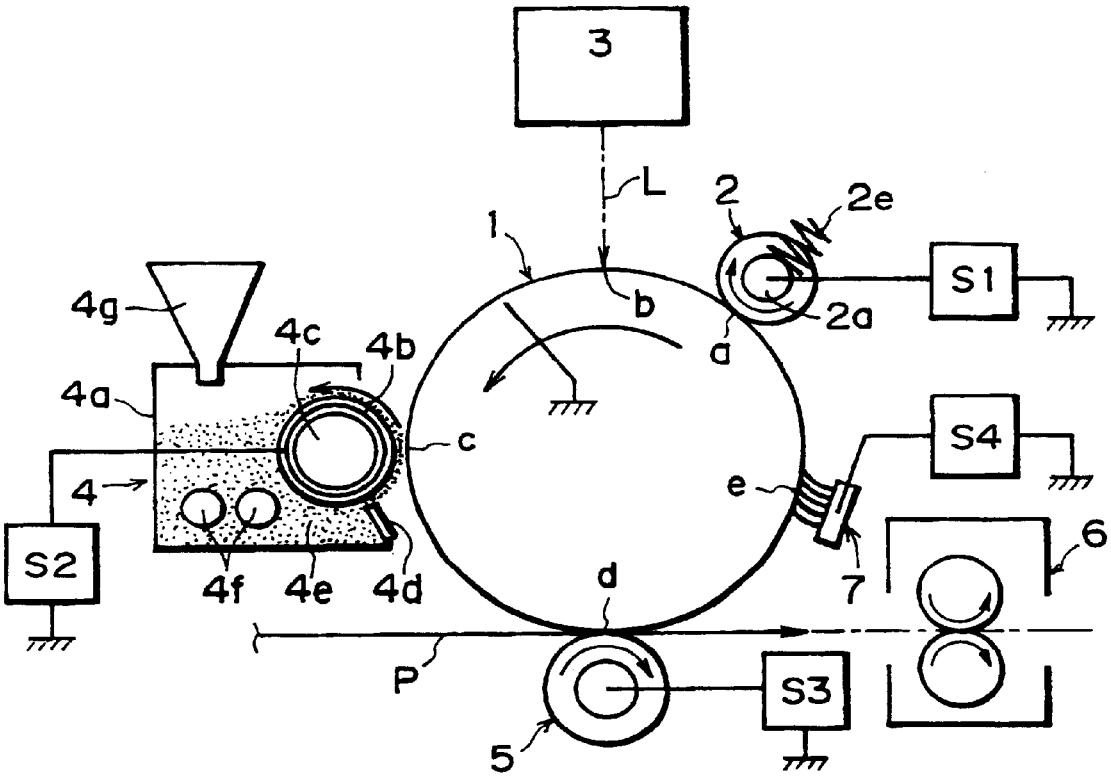
FIG. 1 is a schematic drawing which depicts the general structure of the image forming apparatus in the first embodiment of the present invention.

FIG. 1 is a schematic drawing which depicts the general structure of one of the image forming apparatuses in accordance with the present invention. The image forming apparatus in this embodiment is a laser beam printer which employs a transfer type electrophotographic process, a contact type charging method, a reversal type developing method, and a cleaner-less cleaning method. The size of the largest sheet of paper which can be handled by this image forming apparatus is A3.

(1) General structure of printer a) Image Bearing Member

A referential numeral 1 designates an electrophotographic photosensitive member in the form of a rotatable drum (which hereinafter may be referred to as photosensitive drum). This photosensitive drum 1 is a negatively chargeable, organic, photoconductive member (OPC). It has an external diameter of 50 mm, and is rotationally driven in the counterclockwise direction indicated by an arrow mark, about its central axis, by which it is supported, at a process speed of 100 mm/sec.

Figure 2:
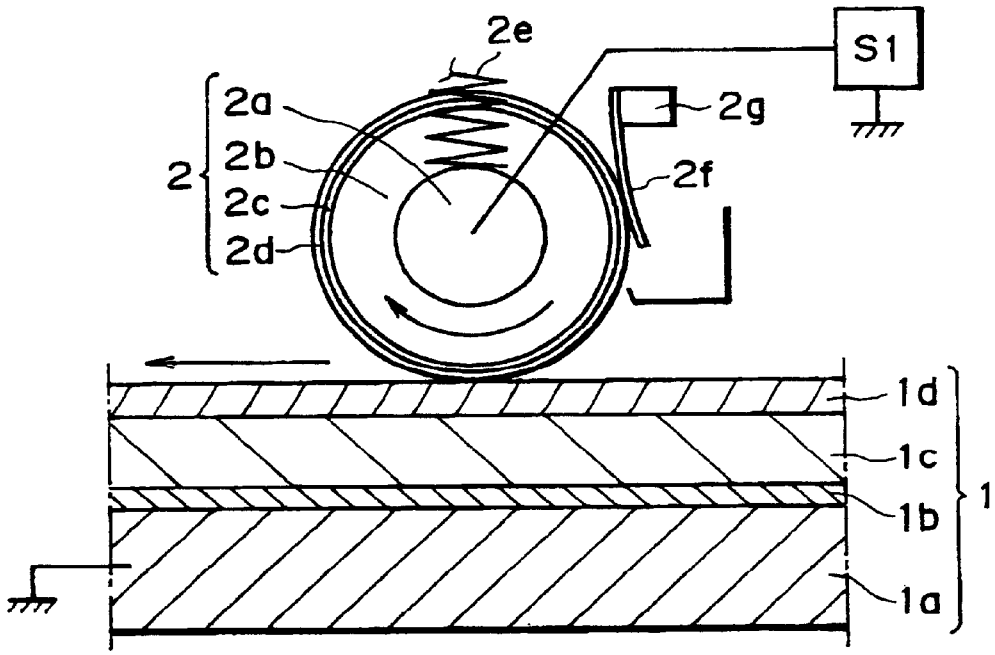
FIG. 2 is a schematic drawing which depicts the laminar structures of the photosensitive drum and charge roller in the first embodiment of the present invention.

Referring to FIG. 2, which shows the laminar structures of the photosensitive drum 1, this photosensitive drum 1 comprises an aluminum cylinder 1*a* (electrically conductive base member), and three layers: an undercoating layer 1*b*, a photoelectric charge generating layer 1*c*, and a charge transfer layer 1*d*, which are coated on the peripheral surface of the aluminum cylinder in the listed order. The undercoating layer 1*b* is coated on the peripheral surface of the aluminum cylinder 1*a* to improve the fixation of the upper layers to the aluminum cylinder.

b) Charging Means

Designated by a referential numeral 2 is a contact type charging apparatus (device) as a charging means for uniformly charging the peripheral surface of the photosensitive drum 1. In this embodiment, it is a charge roller 2 (roller type charging device).

This charge roller 2 is rotationally supported by an unillustrated pair of bearings which support the longitudinal end portions of the metallic core 2*a*, and is kept in contact with the peripheral surface of the photosensitive drum 1 by a predetermined amount of pressure generated by a pair of compression springs 2*e*. It is rotated by the rotation of the photosensitive drum 1. The nip formed between the photosensitive drum 1 and charge roller 2 by the pressing of the charge roller 2 upon the photosensitive drum 1 constitutes a charging station a (charge nip).

The peripheral surface of the rotational photosensitive drum 1 is charged to predetermined polarity and a potential level as a charge bias which satisfies predetermined conditions is applied to the metallic core 2*a* of the charge roller 2. In this embodiment, the charge bias voltage applied to the charge roller 2 is an oscillating compound voltage composed of DC voltage (Vdc) and AC voltage (Vac).

More specifically, the DC voltage is −500 V, and the AC voltage is 1,000 Hz in frequency, 1,400 V in peak-to-peak voltage, and sinusoidal in wave-form. With the application of this oscillating compound voltage, the peripheral surface of the photosensitive drum 1 is uniformly charged to −500 V (dark area potential level Vd).

The charge roller 2 is 320 mm in length, and comprises a metallic core 2*a* (supporting member), and three layers: a bottom layer 2*b*, an intermediary layer 2*c*, and a surface layer 2*d*, which are placed in layers on the peripheral surface of the metallic core 2*a* in this order, as shown in FIG. 2 which schematically shows the laminar structure of the charge roller 2. The bottom layer 2*b* is a layer of foamed sponge for reducing the charging noises, and the intermediary layer 2*c* is an electrically conductive layer for making uniform the overall electrical resistance of the charge roller 2. The surface layer 2*d* is a protective layer for preventing electrical leak even if there are defects such as pin holes on the photosensitive drum 1.

More specifically, the specification of the charge roller 2 in this embodiment is as follows:

metallic core 2*a*: round stainless steel rod with a diameter of 6 mm bottom layer 2*b*: foamed EPDM within which carbon particles are dispersed; it is 0.5/cm$^2$ in specific weight, $10^2$–$10^9$ Ω·cm in volumetric resistivity, 3.0 mm in thickness, and 320 mm in length intermediary layer 2*c*: NBR within which carbon particles are dispersed, and which is $10^2$–$10^5$ Ω·cm in volumetric resistivity, and 700 μm in thickness surface layer 2*d*: TOREGIN resin, that is, a fluorine compound, within which tin oxide particles and carbon particles are dispersed, and which is $10^7$–$10^{10}$ Ω·cm in volumetric resistivity, 1.5 μm in surface roughness (10 points in JIS average surface roughness Ra), and 10 μm in thickness.

In FIG. 2, a reference code 2*f* stands for a charge roller cleaning member, which is a piece of flexible cleaning film in this embodiment. This cleaning film 2*f* is placed in parallel to the longitudinal direction of the charge roller 2, fixed by one of its longer edges to a supporting member 2*g* which reciprocates a predetermined distance. The free edge side of the cleaning film 2*f* is placed in contact with the charge roller 2 so that a contact nip is formed. As the supporting member 2*g* is caused to reciprocate by a predetermined distance in its longitudinal direction by the driver motor of the printer through a gear train, the surface layer 2*d* of the charge roller 2 is rubbed by the cleaning film 2*f*. As a result, the contaminants (microscopic toner particles, additive particles, and the like) adhering to the surface layer 2*d* of the charge roller 2 are removed.

c) Information Writing Means

A referential numeral 3 designates an exposing apparatus as a means for writing the information for forming an electrostatic latent image on the peripheral surface of the charged peripheral surface of the photosensitive drum 1. In this embodiment, it is a laser beam scanner which employs a semiconductor laser. It projects to an exposing position b, a scanning laser beam L (image writing beam) modulated with image formation signals sent to the printer from an unillustrated host apparatus such as an image reading apparatus. At the exposing position b, the uniformly charged peripheral surface of the photosensitive drum 1 is exposed to this scanning laser beam L. As a result, the potential level of the peripheral surface of the photosensitive drum 1 reduces at the points exposed to the laser beam L. Consequently, an electrostatic latent image in accordance with the image formation information written on the charged peripheral surface of the photosensitive drum is continuously formed from the leading end, on the peripheral surface of the photosensitive drum 1.

d) Developing Means

A referential numeral 4 designates a developing apparatus (developing device) as a developing means for developing the electrostatic latent image on the photosensitive drum 1 into a visual image by supplying the electrostatic latent image on the photosensitive drum 1 with developer (toner). In this embodiment, it is a reversal type developing apparatus which employs a developing method based on a two component magnetic brush.

Designated by a referential codes 4*a* and 4*b* are a developing means container, and a nonmagnetic development sleeve, respectively. The development sleeve 4*b* is rotationally supported by the developing means container 4*a* in such a manner that the peripheral surface of the development sleeve 4 is partially exposed from the developing means container 4*a*. A referential code 4*c* designates a magnetic roller which is put through the development sleeve 4*b* and nonrotatively fixed therein; 4*d*, a developer coating blade; 4*e*, two component developer held in the developing means container 4*a*; 4*f*, a developer stirring member disposed in the bottom portion of the developing means container 4*a*; and a referential code 4*g* designates a toner hopper in which toner supply is held.

The two component developer 4*e* within the developing means container 4*a* is a mixture of toner and magnetic carrier, and is stirred by the developer stirring member 4*f*. In this embodiment, the electrical resistance of the magnetic carrier is approximately $10^{13}$ Ω·cm, and its particle diameter is approximately 40 μm. The toner is triboelectrically charged to the negative polarity by being rubbed against magnetic carrier.

The development sleeve 4*b* is disposed adjacent to the photosensitive drum 1 in parallel to 20 the photosensitive drum 1 so that the closest distance (S-Dgap) between the two becomes 350 μm. This portion in which the distance between the development sleeve 4*b* and photosensitive drum 1 is the smallest constitutes a development station c. The development sleeve 4*b* is rotationally driven so that the rotational direction of the peripheral surface of the development sleeve 4*b* in the development station c becomes opposite to the direction in which the peripheral surface of the photosensitive drum 1 moves in the development station c. A certain portion of the two component developer 4*e* within the developing means container 4*a* adheres to the peripheral surface of the development sleeve 4*b*, being retained there in the form of a magnetic brush by the magnetic force of the magnetic roller 4*c* within the development sleeve 4*b*, and is conveyed forward, while being formed into a thinner layer of a predetermined thickness by the developer coating blade 4*d*, as the development sleeve 4*b* is rotationally driven. As the developer 4*e* reaches the development station c, it comes into contact with the peripheral surface of the photosensitive drum and rubs the peripheral surface of the photosensitive drum 1 in a correct manner. To the development sleeve 4*b*, a predetermined development bias is applied from a power source S2. In this embodiment, the development bias voltage applied to the development sleeve 4*b* is an oscillating compound voltage composed of DC voltage (Vdc) and AC voltage (Vac). More specifically:

DC voltage: −350 V

AC voltage: 1,600 V.

The toner within the developer having been coated in a thin layer on the peripheral surface of the rotating development sleeve 4*b* and conveyed to the development station c adheres to the selected points, corresponding to the electrostatic latent image, on the peripheral surface of the photosensitive drum 1 by the electrical field generated by the development bias. As a result, the electrostatic latent image is developed as a toner image. In this embodiment, the toner adheres to the exposed points {light points) on the peripheral surface of the photosensitive drum 1; in other words, the electrostatic latent image is developed in reverse.

The amount of the electrical charge which the toner holds after having been transferred onto the photosensitive drum 1 is −25 $\mu$C/g.

After passing the development station c, the thin layer of the developer on the development sleeve 4*b* is returned to the developer bin within the developing means container as the development sleeve 4*b* is rotated.

In order to keep the toner density within the two component developer 4*e* within the developing means container 4*a*, within a predetermined range, the toner density within the two component developer 4*e* within the developing means container 4*a* is detected by, for example, an unillustrated optical toner density sensor, and the toner hopper 4*g* is driven, while being controlled in response to the information detected by the sensor, so that the toner within the toner hopper is added to the two component developer 4*e* within the developing means container 4*a*. After being added to the two component developer 4*e*, the toner is stirred by the stirring member 4*f*.

e) Transferring Means and Fixing Means

A referential numeral 5 designates a transferring apparatus, which is a transfer roller in this embodiment. This transfer roller 5 is kept in contact with the photosensitive drum 1 with the application of a predetermined amount of pressure, forming a pressure nip, that is, a transfer station d. To this transfer station d, a sheet of transfer medium P (sheet of transfer medium or recording medium onto which an image is to be transferred) is conveyed from an unillustrated-sheet feeding mechanism with a predetermined controlled timing.

After being fed into the transfer station d, the transfer medium P is passed between the photosensitive drum 1 and transfer roller 5, being pinched by them. While the transfer medium P is passed between them, transfer bias is applied to the transfer roller 5 from a power source S3. In this embodiment, the polarity of the transfer bias is positive, which is opposite to the polarity to which the toner is normally charged, that is, negative polarity, and the potential level is +2 kV. As a result, the toner image on the peripheral surface of the photosensitive drum 1 is electrostatically transferred onto the surface of the transfer medium P, continuously starting from the leading end, as the transfer medium P is conveyed through the transfer station d, being pinched between the transfer roller 5 and photosensitive drum 1.

After receiving the toner image while passing through the transfer station d, the transfer medium P is separated from the peripheral surface of the rotating photosensitive drum 1, starting from the leading end, and conveyed to a fixing apparatus 6 (for example, thermal roller type fixing apparatus), in which the toner image is fixed to the transfer medium P. Thereafter, the transfer medium P is outputted as a print or a copy.

(2) Cleaner-less System and Controlling of Toner Charge

The printer in this embodiment is cleaner-less. In other words, it is not equipped with a cleaning apparatus dedicated to remove a small amount of toner particles which remains on the peripheral surface of the photosensitive drum 1 after the transfer of the toner image onto the transfer medium P. Thus, the toner particles remaining on the peripheral surface of the photosensitive drum 1 after the transfer of the toner image are carried to the development station c, through the charge station a and exposure station b, as the photosensitive drum 1 is rotated. In the development station c, the transfer residual toner particles are recovered by the developing apparatus 4, in the process in which the electrostatic latent image on the peripheral surface of the photosensitive drum 1 is developed by the developing apparatus 4 (cleaner-less system).

In this embodiment, the development sleeve 4*b* of the developing apparatus 4 is rotated so that its peripheral surface moves in the direction opposite to the moving direction of the peripheral surface of photosensitive drum 1, in the development station c. Rotating the development sleeve 4*b* in this direction is advantageous in recovering the transfer residual toner particles on the photosensitive drum 1.

Since the transfer residual toner particles on the photosensitive drum 1 are carried through the exposure station b, the charged peripheral surface of the photosensitive drum 1 is exposed through the transfer residual toner particles. Since the amount of the transfer residual toner particles is small, the effects of their presence are not very large.

However, as described before, the transfer residual toner is a mixture of the normally charged toner particles, reversely charged toner particles, and toner particles with an insufficient amount of charge. Among these toner particles, the reversely charged toner particles and toner particles with an insufficient amount of charge adhere to the charge roller 2 as they pass the charge station a. If the charge roller 2 is contaminated by these toner particles beyond a certain level, it fails to properly charge the photosensitive drum 1.

Further, in order to efficiently remove the transfer residual toner particles on the peripheral surface of the photosensitive drum 1 by the developing apparatus 4, in the process in which the electrostatic latent image on the peripheral surface of the photosensitive drum 1 is developed by the developing apparatus 4, it is necessary that the polarity of the transfer residual toner particles on the photosensitive drum 1, which are carried to the development station c, is normal, and also that the amount of their charge is at a level not impedimental to the development of the electrostatic latent image on the photosensitive member. The toner particles with the reverse polarity, and the toner particles with an improper potential level, fail to be removed from the photosensitive member, and also fail to be recovered, by the developing apparatus, effecting an unsatisfactory image.

Thus, in this embodiment, a means 7 for controlling the amount of electrical charge of toner (developer) to make the polarities of all the transfer residual toner particles negative, which is normal, is positioned on the downstream side of the transfer station d and on the upstream side of the charge station a, in terms of the rotational direction of the photosensitive drum 1.

In this embodiment, this toner charge amount controlling means 7 is a member in the form of a brush with a proper amount of electrical conductivity, and is disposed in such a manner that its brush portion remains in contact with the peripheral surface of the photosensitive drum 1. It is supplied with negative voltage from a power source S4. A referential letter e designates an interface between the brush portion of the toner charge amount controlling means 7 and the peripheral surface of the photosensitive drum 1. The polarities of all the transfer residual toner particles on the photosensitive drum 1 are made negative, that is, normal, as they pass through the toner charge amount controlling means 7.

Making the polarities of all the transfer residual toner particles negative, or, normal, increases the mirror forces of the particles with respect to the photosensitive drum 1 when the peripheral surface of the photosensitive drum 1 is charged, with the presence of these transfer residual toner particles on the peripheral surface of the photosensitive drum 1, in the charge station a located further downstream. As a result, the transfer residual toner particles are prevented from adhering to the charge roller 2.

The amount of the charge needed for the above described purpose by the transfer residual toner particles is 2.2 times the amount of the charge needed for the development of the electrostatic latent image by toner.

Figure 3:
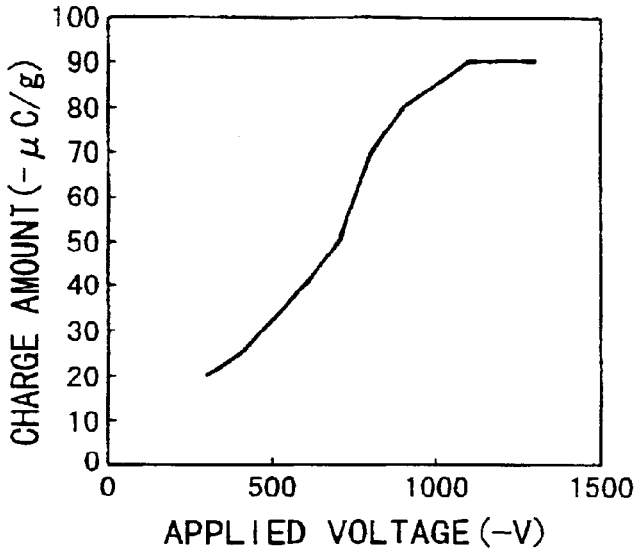
FIG. 3 is a graph which shows the relationship between the amount of the charge applied to the toner charge amount controlling means, and the resultant amount of the electrical charge of the transfer residual toner.

FIG. 3 shows the relationship between the voltage applied to the toner charge amount controlling means 7, and the amount of the toner charge after the passage of the toner through the toner charge amount controlling means 7. When the toner charge amount controlling means 7 is not being supplied with voltage, the amount of the charge of the transfer residual toner is inconsistent, because the transfer residual toner contains negatively charged toner particles from image areas, positively charged toner particles from non-image areas, and reversely charged toner particles, that is, the toner particles, the polarity of which has turned positive due to the positive voltage applied for image transfer, as described before. On the contrary, as the voltage applied to the toner charge amount controlling means is increased, the amount of the charge of the transfer residual toner increases as it passes the toner charge amount controlling means 7. The increase stops at a certain point or a saturation point. The amount of the charge of the toner used in this embodiment at this saturation point was −90 $\mu$C/g.

Figure 4:
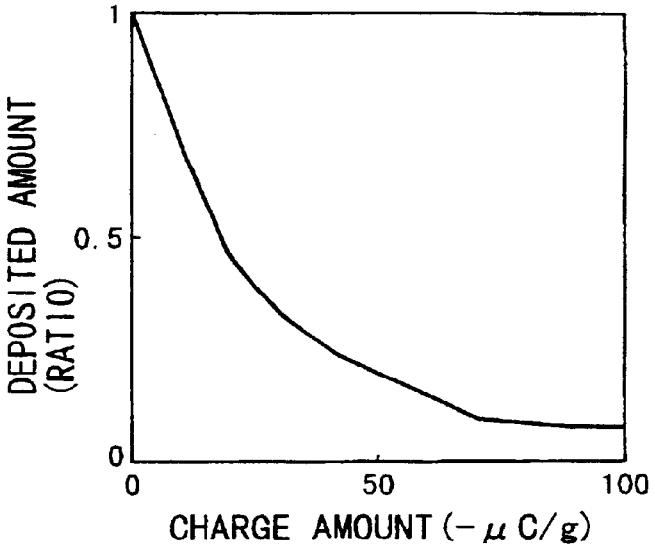
FIG. 4 is a graph which shows the relationship between the amount of the electrical charge held by the transfer residual toner and the amount of the toner which adheres to the charge roller.

FIG. 4 shows the relationship between the amount of the charge of the transfer residual toner and the amount of the transfer residual toner which adhered to the charge roller 2. In FIG. 4, the amount of the transfer residual toner prior to the entry of the transfer residual toner into the charge station a is represented by 1. It is evident from FIG. 4 that as the amount of the charge of the transfer residual toner was increased, the amount of the transfer residual toner which adhered to the charge roller 2 decreased. During this test, images with defects traceable to the adhesion of the transfer residual toner to the charge roller 2 were produced, when the amount of the charge of the transfer residual toner was no more than −55 $\mu$C/g.

Thus, it is evident that in order to prevent the adhesion of the transfer residual toner to the charge roller 2 to prevent the production of images with the defects traceable to improper charging, it is imperative for the amount of the charge of the transfer residual toner to be no less than 2.2 times the amount of the toner charge for latent image development.

In this embodiment, the voltage applied to the toner charge amount controlling means 7 was set at −800 V, and the amount of the charge of the transfer residual toner after its passage through the toner charge amount controlling means 7 was −70 $\mu$C/g.

Next, the recovery of the transfer residual toner in the developing process will be described.

The developing apparatus 4 was as described above, and the image forming apparatus was of a cleaner-less type, in which the transfer residual toner was removed by the developing apparatus 4, in the process in which the electrostatic latent image is developed by the developing apparatus 4. Also as described above, in this embodiment, the amount of the charge of the toner which had been transferred onto the photosensitive drum 1 was −25 $\mu$C/g. Given below in Table 1 is the relationship between the amount of the charge of the transfer residual toner immediately before the transfer residual toner was recovered by the developing apparatus 4, and the efficiency with which the transfer residual toner was recovered, under the development condition in this embodiment.

TABLE 1

| Amount of charge (C/g) | Recovery efficiency |
|---|---|
| −10.0 | not good |
| −12.5 | good |
| −15.0 | good |
| −30.0 | good |
| −40.0 | good |
| −45.0 | good |
| −50.0 | not good |

The amount of the charge of the transfer residual toner on the photosensitive drum 1 immediately before the transfer residual toner is recovered by the developing apparatus 4 is desired to be 0.5–1.8 times the amount of the toner charge for image development (−25 $\mu$C/g).

Figure 5:
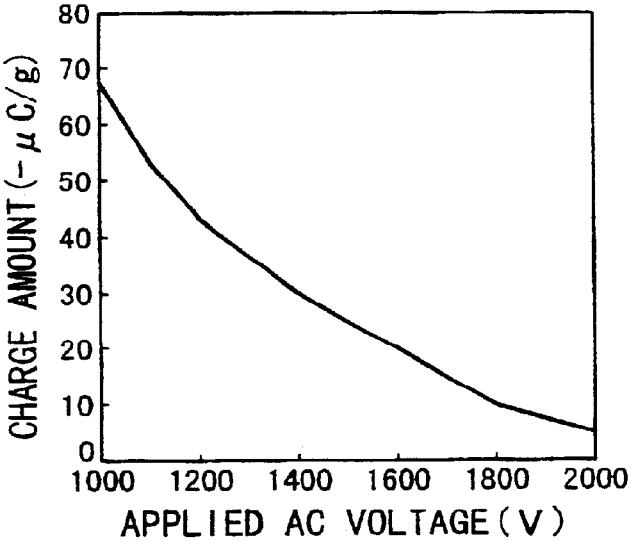
FIG. 5 is a graph which shows the relationship between the amount of the electrical charge held by the toner after the toner passes the charge roller, and the voltage level Vpp of the AC voltage applied to the charge roller.

However, as described above, as the transfer residual toner is passed through the toner charge amount controlling means 7 to prevent the adhesion of the transfer residual toner to the charge roller 2, it is negatively charged by the toner charge amount controlling means 7; more specifically, it is charged to −70 $\mu$C/g. In order to efficiently recover this transfer residual toner with a charge of −70 $\mu$C/g by the developing apparatus 4, the charge of this transfer residual toner must be reduced. The charge of the transfer residual toner is reduced in the charge station a. More specifically, as described above, the charge roller 2 is provided with an AC voltage with a frequency of 1,000 Hz and a peak-to-peak voltage of 1,400 V, and therefore, the charge of the transfer residual toner is reduced by this AC voltage. FIG. 5 shows the relationship between the level of the AC voltage applied to the charge roller 2 and the amount of the charge of the transfer residual toner after the transfer residual toner with a charge of −70 $\mu$C/g was passed through the charge station a to reduce its charge by the AC voltage. In other words, the amount of charge which the transfer residual toner will have after its passage through the charge station a can be adjusted, or removed, by the AC voltage, and the amount of the charge to be removed from the transfer residual toner can be adjusted by adjusting the amount of the AC voltage applied to the charge roller 2. In this embodiment, the AC voltage applied to the charge roller 2 was 1,400 V, and the amount of the charge of the transfer residual toner after its passage through the charge station a was −30 $\mu$C/g. In the developing process, the transfer residual toner particles on the photosensitive drum 1, on the areas onto which toner particles are not to be transferred from the developing apparatus 4, are recovered by the developing apparatus 4 due to the above described reason.

In other words, the polarities of the triboelectical charges of all the transfer residual toner particles on the photosensitive drum 1 are made negative, which is normal, by the toner charge amount controlling means 7 while the transfer residual toner particles are carried from the transfer station d to the charge station a. As a result, the transfer residual toner particles are prevented from adhering to the charge roller 2 while the photosensitive drum 1 is charged to a predetermined potential level by the charge roller 2. Further, after the transfer residual toner is charged to the negative polarity, or the normal polarity, by the toner charge amount controlling means 7, the amount of the charge of the transfer residual toner is adjusted by the charge roller 2 so that the transfer residual toner can be efficiently recovered into the developing apparatus 4 by the development bias applied to the developing apparatus 4 to develop the electrostatic latent image on the photosensitive drum 1. With this arrangement, it is possible to provide an image forming apparatus which does not produce images with defects traceable to improper charging of the photosensitive drum 1, and yet is capable of enhancing the merits of a cleaner-less system.

Figure 6:
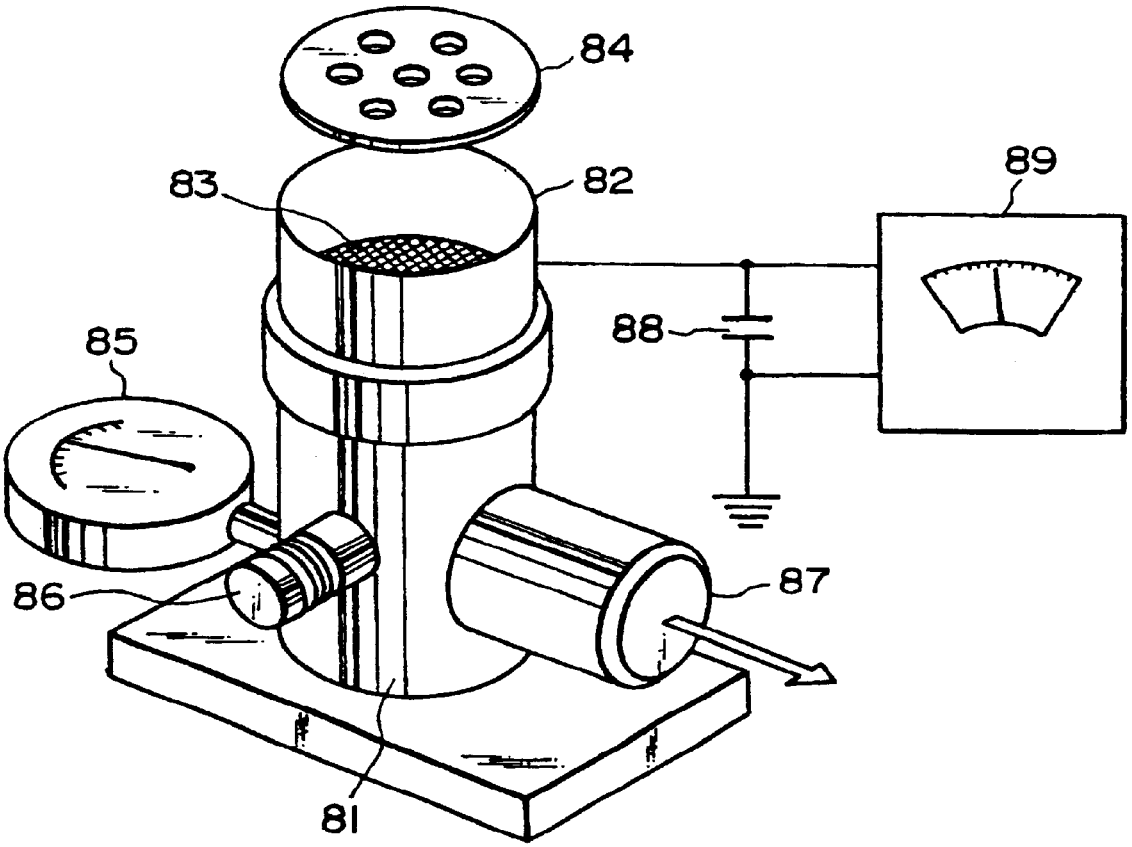
FIG. 6 is a schematic perspective view of an apparatus for measuring the amount of triboelectical charge.

Here, a method for measuring the amount of toner charge will be described. The amount of the triboelectrical charge of toner can be measured in, for example, the following manner (blow-off method). FIG. 6 shows a schematic perspective view of an example of a triboelectrical charge amount measuring apparatus. The developer (toner alone, or mixture of toner and carrier), the triboelectrical charge amount of which is to be measured, is placed in a metallic measurement container 82 with an electrically conductive screen bottom 83, and the container 82 is covered with a metallic lid 84. Then, the weight of the entirety of the measurement container 82 inclusive of its contents is measured. This weight is represented by W1 (g).

Next, toner is removed by sucking air through the measurement container 82, and blowing out of the opening 87, with the use of a sucking apparatus 81 (at least, the portion of the sucking apparatus 81, which makes contact with the measurement container 82, is formed of electrically insulative material), for a sufficient length of time (approximately one minute), with an air volume adjustment valve 86 adjusted so that the pressure indicated by a vacuum gauge 85 remains at 2,450 Pa. During this process, the potential level indicated by an electrometer 89 is directly read, and the read value is represented by V (volt). Designated by a referential numeral 88 is a condenser, and its capacity is represented by C ($\mu$F). After the sucking, the weight of the entirety of the measurement container 82 is measured, and the measured weight is represented by W2 (g). Then, the amount T of the triboelectrical charge of the toner within the developer can be calculated from the following formula:

$$T(\mu C/g)=C\times V/(W1-W2).$$

The amount of the toner charge during the development is measured by placing the toner collected from the peripheral surface of the photosensitive drum 1 during the development, in the measurement container 82.

The amount of the charge of the transfer residual toner after its passage through the toner charge amount controlling means 7 is measured by placing the transfer residual toner collected from the peripheral surface of the photosensitive drum 1 after its passage through the toner charge amount controlling means 7, in the measurement container 82.

The amount of the charge of the transfer residual toner after its passage through the charge station a is measured by placing the transfer residual toner collected from the peripheral surface of the photosensitive drum 1 after its passage through the charge station a, in the measurement container 82.

Embodiment 2

The image forming apparatus (printer) in this embodiment is the same in structure as the one in the first embodiment.

The amount of the electrical charge of developer (toner) varies in response to environment, and also is affected by the physical properties of developer. In this embodiment, therefore, a low humidity environment in which the amount of the charge of the transfer residual toner on the photosensitive drum 1 after development is −35 $\mu$C/g, which is greater than that in the first embodiment, that is, −25 $\mu$C/g, will be described.

The amount of the charge of the transfer residual toner immediately after its passage through the toner charge amount controlling means 7 was −90 $\mu$C/g as described above. Therefore, the transfer residual toner did not adhere to the charge roller 2 in the charge station a, and thus, it did not occur that the photosensitive drum 1 was unsatisfactorily charged.

On the other hand, the amount of the charge of the transfer residual toner after its passage through the charge station a was −40 $\mu$C/g, and thus, the transfer residual toner was satisfactorily recovered into the developing apparatus 4.

Embodiment 3

Figure 7:
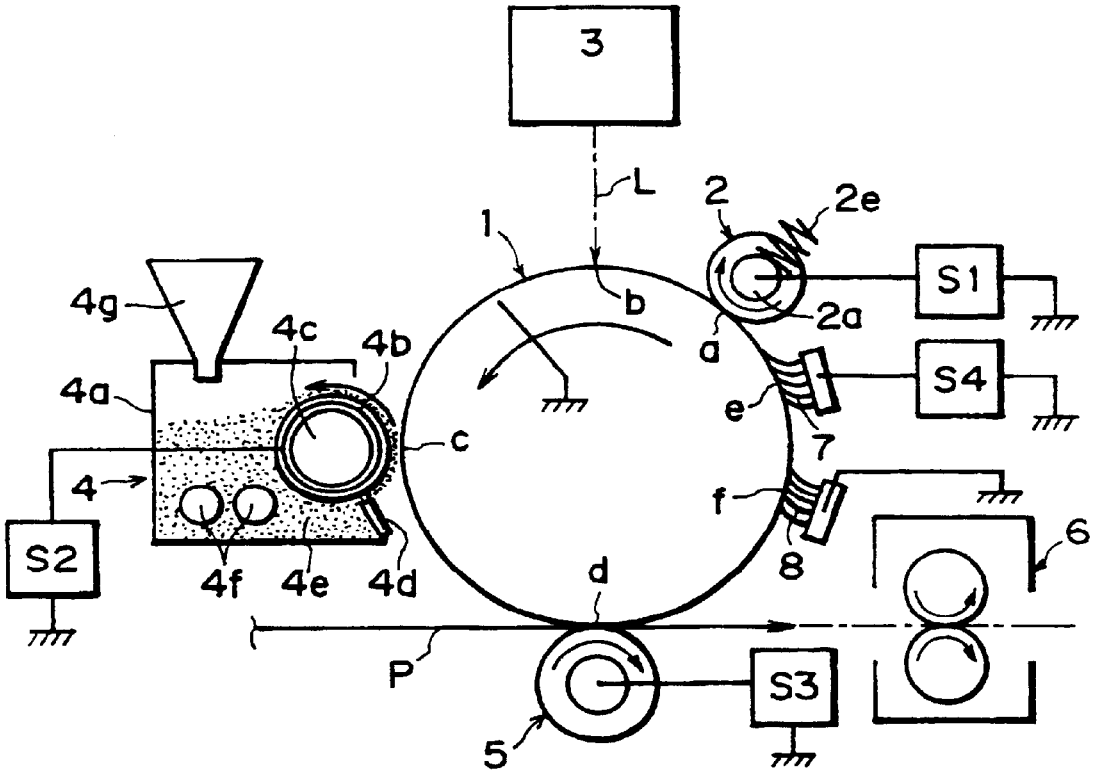
FIG. 7 is schematic drawing which depicts the general structure of the image forming apparatus in the third embodiment of the present invention.

FIG. 7 depicts the third embodiment of the present invention. In FIG. 7, the components and portions identical to those in the embodiment depicted in FIG. 1 are given the same referential codes as those in FIG. 1 so that repetition of the same descriptions can be eliminated.

In this embodiment, the image forming apparatus is provided with a transfer residual toner dispersing means 8 for evenly distributing the transfer residual toner (residual developer image) across the peripheral surface of the photosensitive drum 1. This transfer residual toner dispersing means 8 is positioned on the downstream side of the transfer station d in terms of the rotational direction of the photosensitive drum 1. The image forming apparatus is also provided with the toner (developer) charge amount controlling means 7 for making the polarities of all the transfer residual toner particles, negative, that is, normal. The transfer residual toner charge controlling means 7 is on the downstream side of the transfer residual toner dispersing means 8, and on the upstream side of the charge station a, in terms of the rotational direction of the photosensitive drum 1.

The transfer residual toner reflects the pattern of the image formed during the preceding rotation of the photosensitive drum 1, in particular, when the amount of the transfer residual toner is large. However, with the provision of the transfer residual toner dispersing means 8, the transfer residual toner is evenly distributed across the peripheral surface of the photosensitive drum 1, in other words, the pattern is dispersed, before it reaches the toner charge amount controlling means 7 after leaving the transfer station d. Therefore, it does not occur that the transfer residual toner concentrates onto certain portions of the toner charge amount controlling means 7. Without the concentration of the transfer residual toner onto the certain portions of the toner charge amount controlling means 7, the entirety of the transfer residual toner is always satisfactorily charged to the normal polarity, being therefore prevented from adhering to the charge roller 2. Consequently, a ghost image, or an image traceable to the transfer residual toner pattern, is not created.

Embodiment 4

The structure of the image forming apparatus (printer) in this embodiment is the same as that in the third embodiment.

The transfer residual toner dispersing means 8 may he provided with DC voltage. With the application of DC voltage to the transfer residual toner dispersing means 8, the transfer residual toner is temporarily attracted to the transfer residual toner dispersing means 8. Even in this case, however, there is a limit to the amount of the toner which can be held by the transfer residual toner dispersing means 8 as in the preceding embodiment. Therefore, after the amount of the transfer residual toner having attracted to the transfer residual toner dispersing means 8 reaches the capacity of the transfer residual toner dispersing means 8, the transfer residual toner gradually falls off from the transfer residual toner dispersing means 8, adheres to the peripheral surface of the photosensitive drum 1, and is carried forward. However, as the transfer residual toner falls off from the transfer residual toner dispersing means 8, it is evenly dispersed or distributed across the peripheral surface of the photosensitive drum 1; in other words, the distribution of the transfer residual toner becomes even across the peripheral surface of the photosensitive drum 1.

In this embodiment, a DC voltage of −300 V was applied to the transfer residual toner dispersing means 8.

Miscellanies

1) Although the transfer residual toner dispersing means 8 and toner charge amount controlling means 7 in the preceding embodiments were in the form of a fixed member in the form of a brush, their configuration is optional; they may be in the form of a rotational brush, an elastic roller, a member in the form of a sheet, or the like.

2) The image bearing member may be of a type which is provided with an charge injectable layer with a surface resistance of $10^9$–$10^{14}$ Ω·cm, and into which charge can be directly injected. Even when an image bearing member is not provided with a charge injectable layer, effects similar to the aforementioned effects can be obtained as long as, for example, the electrical resistance of the charge transfer layer of the image bearing member is within the above described range. Further, the image bearing member may be an amorphous silicon based photosensitive member, the volumetric resistivity of the surface layer of which is approximately $10^{13}$ Ω·cm.

3) The contact type flexible charging member may be different from the above described one in shape as well as material; for example, a fur brush, a piece of felt, a piece of fabric, or the like, may be used in place of the charge roller. Further, various materials may be employed in combination so that a contact type flexible charging member superior in elasticity, electrical conductivity, surface property, and durability than the one employed in the preceding embodiments can be obtained.

4) The wave-form of the AC voltage (AC component, or voltage which periodically changes in voltage value) applied to the contact type charging member and developing member to generate an oscillating electric field is optional; it may be sinusoidal, rectangular, triangular, or the like. It may be in the form of a rectangular wave formed by periodically turning on and off a DC power source.

5) The exposing means as a means for writing the image information on the charged surface of the photosensitive drum as an image bearing member may be a digital exposing means employing an array of light emitting elements in a solid state, such as an array of LEDs, instead of the exposing means based on the scanning laser beam in the preceding embodiments. It also may be an analog exposing means which employs a halogen lamp, a fluorescent lamp, or the like, as a means for illuminating an original. In essence, any exposing means is acceptable as long as it can form an electrostatic latent image in accordance with image formation information.

6) The image bearing member may be an electrostatically recordable dielectric member or the like. In the case of an electrostatically recordable dielectric member, it is uniformly charged, and then, the charge on it is selectively removed with the use of a charge removing means such as a charging removing needle head, an electron gun, or the like, to write an electrostatic latent image in accordance with the information of an intended image.

7) The selection of the method and means for developing an electrostatic latent image with the use of toner is optional. The method may be a reverse developing method or a normal developing method.

Generally speaking, methods for developing an electrostatic latent image can be roughly divided into four categories: a single component non-contact developing method, a single component contact developing method, a two component contact developing method, and a two component non-contact developing method. In a single component non-contact developing method, nonmagnetic toner is coated on a member, in the form of a sleeve, or the like, for bearing and conveying the toner, with the use of a blade or the like, whereas magnetic toner is coated on a member for bearing and conveying the toner, with the use of magnetic force. In the development station, the toner is transferred from the developer bearing member to a photosensitive member to develop the electrostatic latent image on the photosensitive member, without contact between the toner layer on the developer bearing member, and the photosensitive member. In a single component contact developing method, the layer of the toner coated on a member for bearing and conveying developer as described above is placed in contact with an image bearing member to develop the electrostatic latent image on the image bearing member. In a two component contact developing method, developer (two component developer), which is a mixture of toner and magnetic carrier, is borne and conveyed in a layer on a member for bearing and conveying developer, with the use of magnetic force, and the layer of the two component developer is placed in contact with the image bearing member to develop the electrostatic latent image on the image bearing member. In a two component non-contact developing method, the above described two component developer is transferred onto the image bearing member, without contact between the layer of the two component developer and the image bearing member.

8) The selection of the transferring means is not limited to the transferring means in the preceding embodiments, which is a transfer roller; a transferring means may be in the form of a blade, a belt, or the like. Further, a method for applying transfer bias may be of a contact type, or a non-contact type which employs a corona type charging device.

9) Not only is the present invention applicable to a monochromatic image forming apparatus, but also to an image forming apparatus for forming a multicolor image and a full-color image, through a multilayer transfer process or the like, with the use of an intermediary transfer member such as a transfer drum, a transfer belt, or the like.

As described above, according to the present invention, it is possible to provide a cleaner-less image forming apparatus in which transfer residual developer, that is, the developer remaining on an image bearing member after a transfer process, is removed from the image bearing member, and is recovered, by a developing apparatus in the process in which the electrostatic latent image on the image bearing member is developed by the developing apparatus, and which is characterized in that the transfer residual toner is prevented from adhering to the charging means, and is efficiently recovered by the developing means, so that unsatisfactory charging of the image bearing member, and the production of a defective image, do not occur. In other words, it is possible to provide a cleaner-less image forming apparatus which enhances the merits of a cleaner-less system.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member for bearing an electrostatic image;

developing means for developing the electrostatic image on said image bearing member with toner electrically charged to a predetermined polarity;

transfer means for transferring the toner image from said image bearing member to a transfer material;

toner charging means for electrically charging residual toner remaining on said image bearing member to the same polarity as the predetermined polarity; and an image bearing member charging means for contacting to said image bearing member carrying the toner charged by said toner charging means to electrically charge said image bearing member to the same polarity as the predetermined polarity at a charging position, said image bearing member charging means being effective to change an amount of electric charge of the toner such that the amount of electric charge after the toner passes by the charging position is smaller than the amount of electric charge before the toner reaches the charging position.

2. An apparatus according to claim 1, further comprising electrostatic image forming means for forming the electrostatic image on said image bearing member electrically charged by said image bearing member charging means.

3. An apparatus according to claim 1, wherein said developing means collects the residual toner remaining on said image bearing member.

4. An apparatus according to claim 1, wherein said image bearing member charging means includes a contact charging member and a voltage source for applying an oscillating voltage to said contact charging member.

5. An apparatus according to claim 1, wherein said toner charging means electrically charges the toner to a charge amount which is not less than 2.2 times that during developing operation.

6. An apparatus according to claim 5, wherein said image bearing member charging means reduces the charge amount to 0.5–1.8 times that during the developing operation.

7. An apparatus according to claim 1, further comprising a scattering member for scattering the residual toner image, said scattering member being disposed downstream of said transfer means and upstream of said toner charging means with respect to a movement direction of said image bearing member.

8. An image forming apparatus comprising:

an image bearing member for bearing an electrostatic image;

developing means for developing the electrostatic image on said image bearing member with toner electrically charged to a predetermined polarity;

transfer means for transferring the toner image from said image bearing member to a transfer material;

toner charging means for electrically charging residual toner remaining on said image bearing member to the same polarity as the predetermined polarity; and an image bearing member charging means for contacting to said image bearing member carrying the toner charged by said toner charging means to electrically charge said image bearing member to the same polarity as the predetermined polarity, said image bearing member charging means being effective to reduce a charge amount of the toner, wherein said image bearing member charging means includes a contact charging member and a voltage source for applying an oscillating voltage to said contact charging member.

9. An apparatus according to claim 8, further comprising electrostatic image forming means for forming the electrostatic image on said image bearing member electrically charged by said image bearing member charging means.

10. An apparatus according to claim 8, wherein said developing means collects the residual toner remaining on said image bearing member.

11. An apparatus according to claim 8, wherein said toner charging means electrically charges the toner to a charge amount which is not less than 2.2 times that during developing operation.

12. An apparatus according to claim 11, wherein said image bearing member charging means reduces the charge amount to 0.5–1.8 times that during the developing operation.

13. An apparatus according to claim 7, further comprising a scattering member for scattering the residual toner image, said scattering member being disposed downstream of said transfer means and upstream of said toner charging means with respect to a movement direction of said image bearing member.

14. An image forming apparatus comprising:

an image bearing member for bearing an electrostatic image;

developing means for developing the electrostatic image on said image bearing member with toner electrically charged to a predetermined polarity;

transfer means for transferring the toner image from said image bearing member to a transfer material;

toner charging means for electrically charging residual toner remaining on said image bearing member to the same polarity as the predetermined polarity;

an image bearing member charging means for contacting to said image bearing member carrying the toner charged by said toner charging means to electrically charge said image bearing member to the same polarity as the predetermined polarity, said image bearing member charging means being effective to reduce a charge amount of the toner; and a scattering member for scattering the residual toner image, said scattering member being disposed downstream of said transfer means and upstream of said toner charging means with respect to a movement direction of said image bearing member.

15. An apparatus according to claim 14, further comprising electrostatic image forming means for forming the electrostatic image on said image bearing member electrically charged by said image being member charging means.

16. An apparatus according to claim 14, wherein said developing means collects the residual toner remaining on said image bearing member.

17. An apparatus according to claim 14, wherein said toner charging means electrically charges the toner to a charge amount which is not less that 2.2 times that during developing operation.

18. An apparatus according to claim 17, wherein said image bearing member charging means reduces the charge amount to 0.5–1.8 times that during the developing operation.

* * * * *

UNITED STATES PATENT AND TRADEMARK OFFICE

CERTIFICATE OF CORRECTION

PATENT NO. : 6,421,512 B2 
DATED : July 16, 2002
INVENTOR(S) : Yasunari Watanabe et al.

It is certified that error appears in the above-identified patent and that said Letters Patent is hereby corrected as shown below:

Column 1,
Line 45, “is not” should read -- not be --.

Column 3,
Line 25, “above described” should read -- above-described --; and
Line 46, “to” should be deleted.

Column 4,
Line 12, “triboelectical” should read -- triboelectrical --.

Column 5,
Line 40, “surface” should read -- ¶surface --; and
Line 49, “in” (second occurrence) should be deleted.

Column 6,
Line 24, “a” (first occurrence) should be deleted; and
Line 47, “in” should be deleted an “20 the” should Column 7,
Line 18, “{light” should read -- (light --; and
Line 49, “unillustrated-sheet” should read -- unillustrated sheet --.

Column 8,
Lines 53 and 54, “is” should read -- be --.

Column 9,
Line 23, “above described” should read -- above-described --.

Column 10,
Line 66, “above” should read -- above- --.

Column 13,
Line 6, “having” should read -- having been --;
Line 28, “an” should read -- a --;
Line 33, “above described” should read -- above-described --; and
Line 39, “above described” should read -- above-described --.

UNITED STATES PATENT AND TRADEMARK OFFICE

CERTIFICATE OF CORRECTION

PATENT NO. : 6,421,512 B2 
DATED : July 16, 2002
INVENTOR(S) : Yasunari Watanabe et al.

It is certified that error appears in the above-identified patent and that said Letters Patent is hereby corrected as shown below:

Column 14,
Line 36, “above described” should read -- above-described --.

Column 16,
Line 54, “being” should read -- bearing --.

Signed and Sealed this

Fourteenth Day of January, 2003

JAMES E. ROGAN
*Director of the United States Patent and Trademark Office*